US006692193B2

(12) United States Patent
Beynet et al.

(10) Patent No.: US 6,692,193 B2
(45) Date of Patent: Feb. 17, 2004

(54) DEDICATED RISER TENSIONER APPARATUS, METHOD AND SYSTEM

(75) Inventors: Pierre Beynet, Houston, TX (US); Jerome Burns, Seattle, WA (US)

(73) Assignee: Technip France, Courbevoie (FR)

( * ) Notice: Subject to any disclaimer, the term of this patent is extended or adjusted under 35 U.S.C. 154(b) by 0 days.

(21) Appl. No.: 09/969,479

(22) Filed: Oct. 2, 2001

(65) Prior Publication Data

US 2003/0063953 A1 Apr. 3, 2003

(51) Int. Cl.[7] ..... E02D 15/00
(52) U.S. Cl. ..... 405/224.4; 166/355
(58) Field of Search ..... 405/224, 224.2, 405/224.3, 224.4; 166/355

(56) References Cited

U.S. PATENT DOCUMENTS

| | | | | |
|---|---|---|---|---|
| 4,379,657 A | * | 4/1983 | Widiner et al. | 405/168.4 |
| 4,470,721 A | * | 9/1984 | Shotbolt | 114/264 |
| 4,702,321 A | | 10/1987 | Horton | |
| 4,740,109 A | | 4/1988 | Horton | |
| 5,427,180 A | | 6/1995 | Leite et al. | |
| 5,706,897 A | | 1/1998 | Horton, III | |
| 5,873,416 A | | 2/1999 | Horton, III | |
| 5,881,815 A | | 3/1999 | Horton, III | |
| 6,431,284 B1 | * | 8/2002 | Finn et al. | 166/350 |
| 2002/0000321 A1 | * | 1/2002 | Reynolds | 166/355 |

FOREIGN PATENT DOCUMENTS

| | | |
|---|---|---|
| EP | 0 390 728 A2 | 3/1990 |
| WO | WO 99/50136 A1 | 7/1999 |
| WO | WO 00/66871 | 9/2000 |
| WO | WO 01/16458 A1 | 8/2001 |

* cited by examiner

*Primary Examiner*—Heather Shackelford
*Assistant Examiner*—Lisa M. Saldano
(74) *Attorney, Agent, or Firm*—Klein, O'Neill & Singh

(57) ABSTRACT

The invention is an apparatus, method and system for supporting risers in a floating platform. The apparatus comprises a table disposed above a hull-top surface, a first riser opening in the table, and a first dedicated riser tensioner attached to the table and disposed about the first riser opening. The apparatus further comprises a second riser opening, and a second dedicated riser tensioner attached to the table and disposed about the second riser opening. The method comprises tensioning a first riser with a first dedicated riser tensioner, and tensioning a second riser with a second dedicated riser tensioner, wherein the first dedicated riser tensioner is responsive to the second dedicated riser tensioner. The system comprises a mechanism for tensioning a first and a second riser, wherein the mechanism for tensioning the first riser is responsive to the second riser.

11 Claims, 4 Drawing Sheets

| EXAMPLES | |
|---|---|
| B1-1 | D5-1 |
| B1-2 | D5-2 |
| B1-3 | D5-3 |
| B1-4 | D5-4 |
| D2-1 | B4-1 |
| D2-2 | B4-2 |
| D2-3 | B4-3 |
| D2-4 | B4-4 |

DEDICATED RISER TENSIONER APPARATUS, METHOD AND SYSTEM

BACKGROUND OF THE INVENTION

Drilling and production operations for the exploration and production of offshore minerals require a floating platform that is as stable as possible against environmental forces. To avoid fatigue on the risers, some floating platforms (e.g., Spars) have drilling and production risers that are supported by buoyancy "cans" attached to each of the individual risers. As the water depth increases, larger buoyancy cans are used to support the in-water weight of the risers. Larger buoyancy cans require larger center-wells, which, in turn, increase the hull diameter. Increasing the hull diameter increases the hydrodynamic environmental loads acting on the platform. A larger mooring system is then required to withstand the increased environmental loads. These undesirable effects increase the fabrication and installation costs.

With present buoyancy can riser support systems, as the hull displaces laterally in response to environmental loads, the risers undergo a considerable amount of downward motion, or pull-down, with respect to the hull. Counterbalancing these environmental loads is crucial in order to avoid destruction of the risers or the platform. Counterbalancing environmental loads by tying the risers to a single table, gimballing the risers, or both, provide some additional support, but such systems still cannot support large tensile loads possible in offshore environments.

A need, therefore, exists for an improved apparatus, method and system that support drilling and production risers.

SUMMARY OF THE INVENTION

The described problems in supporting drilling and production risers are addressed by an apparatus, method and system having a dedicated riser tensioner for each riser, thereby allowing each riser to move vertically independently of the other risers without requiring gimballing. Further, the invention cross-couples the dedicated riser tensioners as a way to soften motions other than heave.

According to one aspect of the present invention, an apparatus is provided for supporting risers in a floating platform. The apparatus comprises a table disposed above a hull-top surface, a first riser opening in the table, and a first dedicated riser tensioner attached to the table and disposed about the first riser opening. The apparatus further comprises a second riser opening, and a second dedicated riser tensioner attached to the table and disposed about the second riser opening.

According to another aspect of the invention, a method is provided for supporting risers in a floating platform. The method comprises tensioning a first riser with a first dedicated riser tensioner. In addition, the method comprises tensioning a second riser with a second dedicated riser tensioner, wherein the first dedicated riser tensioner is responsive to the second dedicated riser tensioner.

According to another aspect of the invention, a system is provided for supporting risers in a floating platform. The system comprises a means for tensioning a first riser and a means for tensioning a second riser, wherein the means for tensioning a first riser is responsive to a means for tensioning a second riser.

DESCRIPTION OF EXAMPLE EMBODIMENTS OF THE INVENTION

Figure 1:
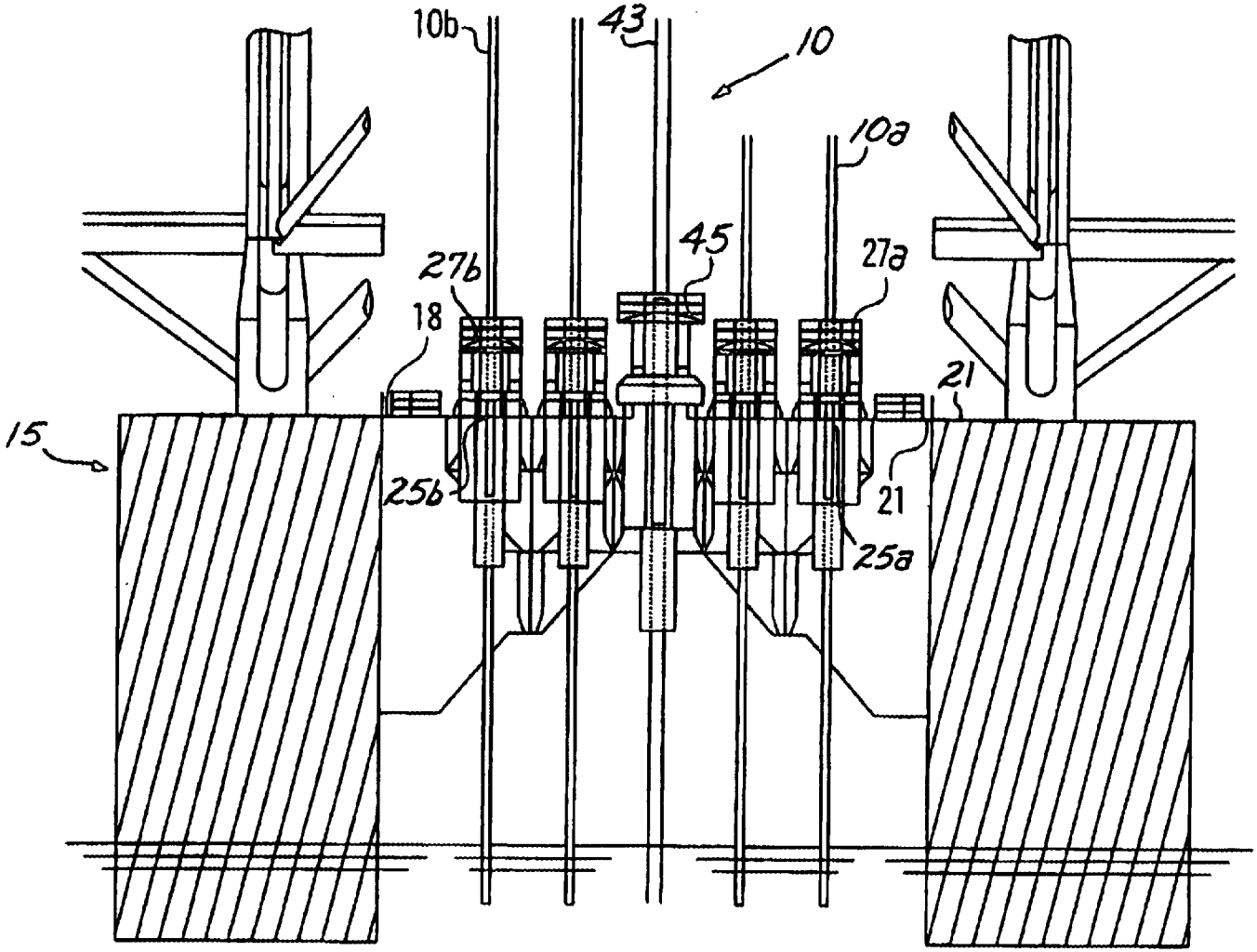
FIG. 1 is a cross-section of an example embodiment of the invention showing a Spar-type floating platform showing the risers and dedicated riser tensioners.
Figure 2:
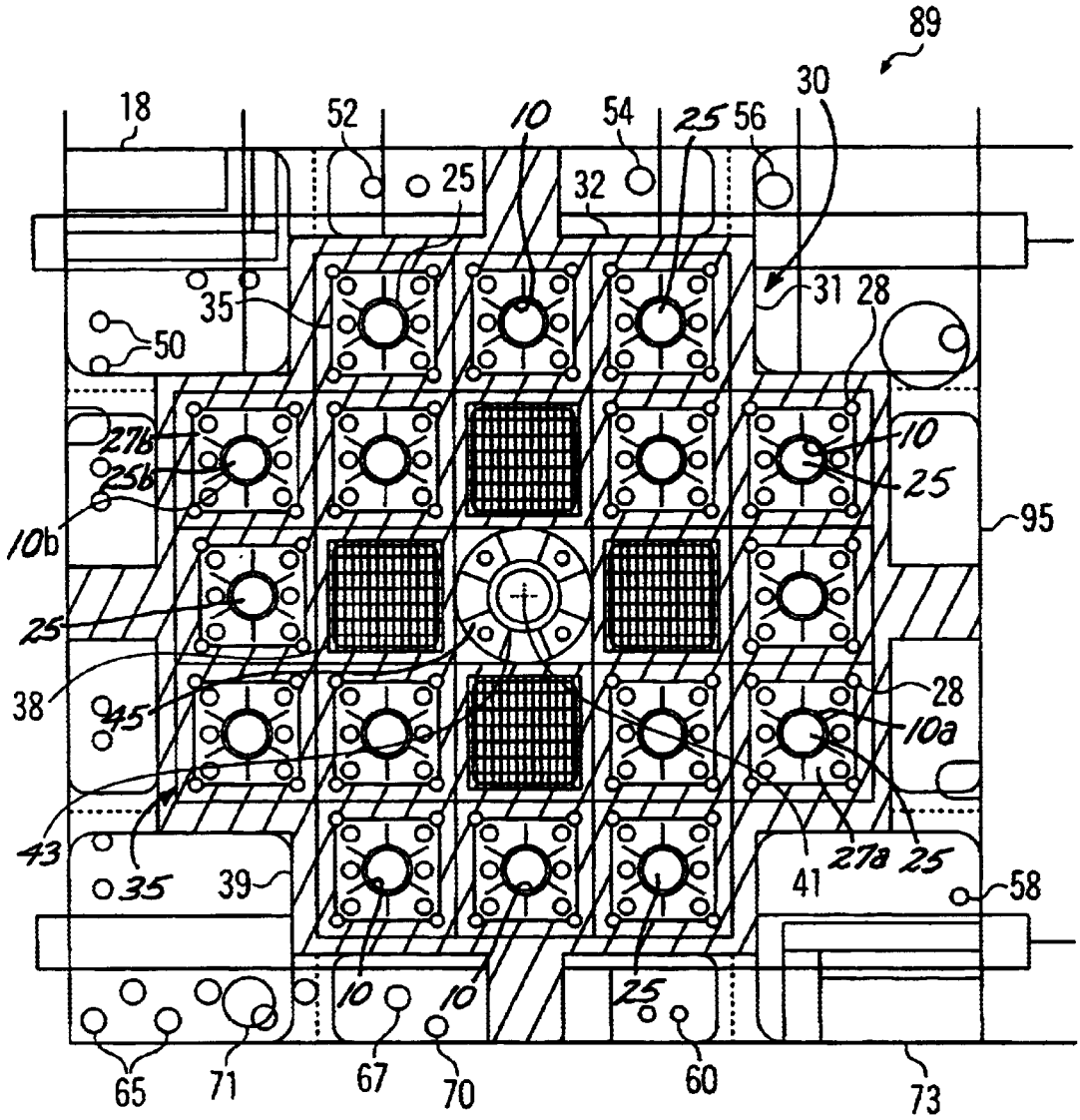
FIG. 2 is a top view of an example embodiment of the invention showing a Spar-type floating platform having a table, riser openings, risers, pull tube openings, pull tubes, miscellaneous openings, access shaft, and the Spar-hull.

Referring now to FIGS. 1 and 2, an apparatus for supporting risers 10, including risers 10*a* and 10*b* in a Spar-type floating platform 15 is seen. A table 18 is disposed above a hull top surface 21 and includes a plurality of riser openings 25, including a first riser opening 25*a* receiving the first riser 10*a*, and a first dedicated riser tensioner 27*a* that is attached to the table 18 and disposed about the first riser opening 25*a*. A second dedicated riser tensioner 27*b* is disposed about a second riser opening 25*b* receiving the second riser 10*b*. In further embodiments of the invention, more than two risers 10*a* and 10*b*, dedicated riser tensioners 27*a*, 27*b*, and riser openings 25*a* and 25*b* are used.

Turning now to FIG. 2, a top view of the invention is seen in which the table 18 comprises a grid 30. The grid 30 has rows 31 and columns 32 that intersect to form square areas 35. Further, each of these areas 35 is capable of having one of the riser openings 25 to accept one of the risers 10. Also shown in FIG. 2, the table 18 comprises at least two riser openings 25*a*, 25*b* that respectively receive the risers 10*a*, 10*b*. Two dedicated riser tensioners 27*a*, 27*b* are attached to the table 18 and are respectively disposed about the riser openings 25*a*, 25*b*. The two riser openings 25*a*, 25*b* are located in square areas 35 defined in the grid 30 that are located symmetrically with respect to the center of the grid 30. Preferably, all of the riser openings 25 are paired in locations (i.e., square areas 35) that are symmetrical with respect to the center of the grid 30. In other words, each riser opening 25 has a corresponding riser opening 25 with which it forms a symmetrical pair with respect to the center of the grid 30, in the way that the riser openings 25*a*, 25*b* are symmetrically paired. In the illustrated embodiment, a drilling riser opening 41 is located in the center of the grid 30 to receive a drilling riser 43. A drilling riser tensioner 45 is disposed about the drilling riser opening 41. If there is only a single drilling riser, it is preferable to locate it in the center of the grid 30, as shown in FIG. 2. If the table 18 is provided with two drilling risers, they would be arranged symmetrically relative to the center of the grid as described above for the risers 10. (This feature will further explained below with respect to FIG. 3.) Further still, every area 35 need not be utilized on the table 18. In the example embodiment shown in FIG. 2, the areas 35 that have riser openings 25 comprise a quincunxial arrangement 38 located in the middle of the grid 30, with one drilling riser opening 41 and four riser openings 25. A "quincunxial" arrangement is identical to the dot representation of the number five on a standard die.

The four lateral sides of the quincunxial arrangement comprise a linear arrangement of three areas 35 having riser openings 25 adjoining each one of the lateral sides. That is, each of the four lateral sides has three areas 35. As seen, the riser openings 25 are in a linear arrangement 39 in each one of the lateral sides of the grid 30. In the illustrated example, the table 18 comprises sixteen riser openings 25 and one central drilling riser opening 42. Except for the single, central drilling riser opening 41, each riser opening 25 defined in the grid is paired with another riser opening 25 symmetrically relative to the center of the grid 30, as described above, and as shown in FIG. 2.

Other example embodiments of the invention comprise sizes, numbers, and shapes of the areas 35 that are different from the gridwork on the table 18. Further, other example embodiments include different numbers and types of riser openings 25 in the table 18.

Referring now to FIGS. 1 and 2, in some example embodiments of the invention, at least one of the risers 10 comprises a drilling riser (typically located in the center of the grid 30). According to alternative embodiments, at least one of the risers 10 comprises a production riser. Further, variations in the number of risers 10 are within the scope and spirit of the invention. However, each of the risers 10 is tensioned by a dedicated riser tensioner such as riser tensioners 27*a* and 27*b*, whether the riser is a production riser or a drilling riser.

Focusing now on FIG. 2, according to another example embodiment of the invention, the dedicated riser tensioners 27*a* and 27*b* comprise a plurality of cylinders 28. The plurality of cylinders 28, in some embodiments, comprises four cylinders 28 coupled to each riser 10. In some examples, the cylinders 28 comprise pneumatic cylinders; while, in other embodiments, cylinders 28 comprise hydraulic cylinders. Other types of cylinders 28 are useful in other example embodiments of the invention, as are mixtures of the types of cylinders 28.

A plurality of pull tubes 50 is dispersed near the edges of the table 18. The pull tubes 50 comprise at least one flowline pull tube 52, at least one export gas pull tube 54, at least one export oil pull tube 56, at least one commercial umbilical pull tube 58, and at least one umbilical pull tube 60. Inclusion or exclusion of some or all of these pull tubes 50 are useful according to various embodiments, as are other pull tubes 50 not specifically mentioned.

A plurality of openings 65 are dispersed near the edges of the table 18. According to some such example embodiments, the following are provided: at least one seawater opening 67, at least one jockey opening 70, at least one seachest feed 71, and at least one access shaft 73. Inclusion or exclusion of some or all of these openings 65 is within the scope of the present invention, as are other openings 65 not specifically mentioned above.

Figure 3:
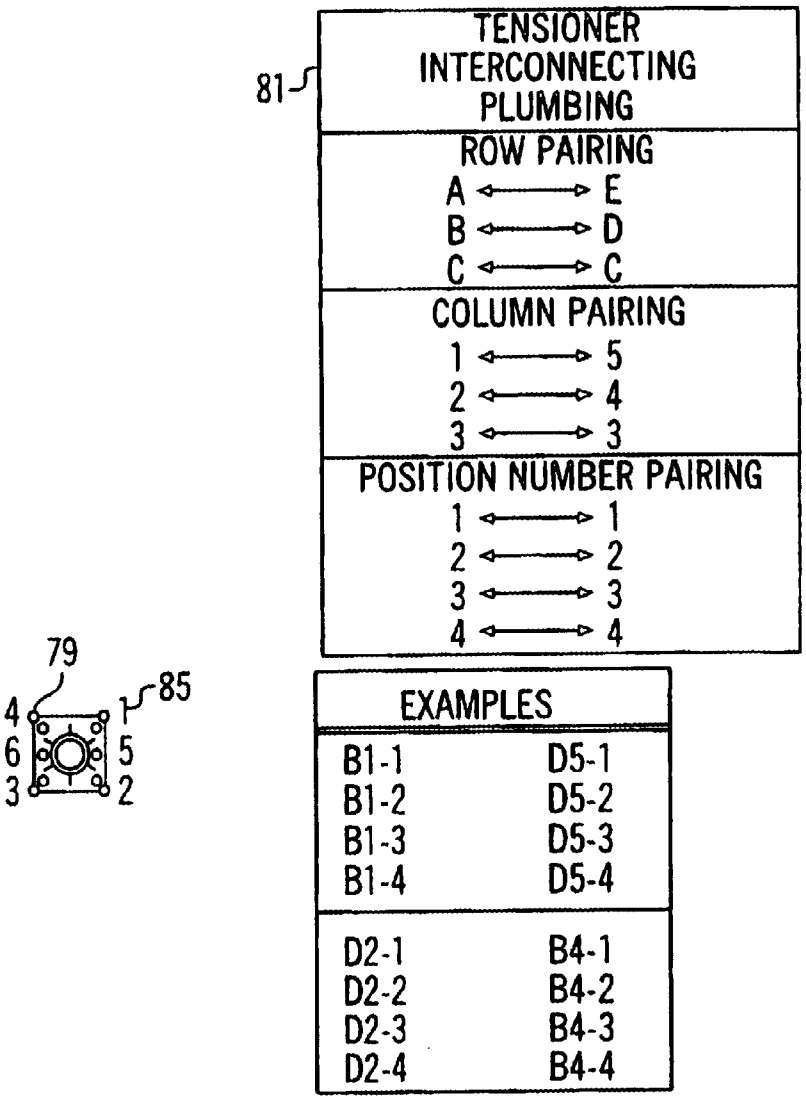
FIG. 3 is a schematic view of an example embodiment of the invention showing a cross-coupling arrangement between the dedicated riser tensioners.

Now referring to FIGS. 1 and 3, according to other example embodiments of the invention, at least a first dedicated riser tensioner 27*a* and a second riser tenioner 27*b* are engaged in a cross-coupling arrangement 75. While it is production dedicated riser tensioners 27*a* and 27*b* engaged in cross-coupling arrangements 75, as shown, other types of dedicated riser tensioners (e.g., drilling riser tensioners) are cross-coupled in other embodiments of the invention. Further, more than two riser tensioners 27*a* and 27*b* are engaged in a cross-coupling arrangement in alternative embodiments. For example, as shown in FIG. 3, sixteen dedicated riser tensioners 27*a* and 27*b* are engaged in a cross-coupling arrangement. In the illustrated example, each of the riser tensioners 27*a* and 27*b* comprises a set of cylinders 28 for supporting a riser 10. For example, the first riser tensioner 27*a* comprises a first set of four cylinders 28*a* for supporting the first riser 10*a*, and the second riser tensioner 27*b* comprises a second set of four cylinders 28*b* for supporting the second riser 10*b*. It is these first and second sets of cylinders 28*a*, 28*b* that are the subject of the cross-coupling arrangement 75 and form a cross-coupling circuit 91. In one example of the invention, there is a symmetrical pairing, as defined in the table 81 shown in FIG. 3, of the first set of cylinders 28*a* in the first riser tensioner 27*a* with the second set of cylinders 28*b* in the second riser tensioner 27*b*. In various embodiments, symmetry pairing in the cylinders 28 balances environmental loads. In the illustrated example, a cross-soupling arrangement of the cylinders 28 of a riser tensioner 27 with the cylinders 28 of another riser tensioner comprises symmetrical pairing 81 by rows 31, or by columns 32, or a combination of both, and of reference for these symmetrical pairings 81 is determined from the center of the grid 30.

To elaborate on the cross-coupling arrangement 75 involving symmetrical pairing 81 by rows 31, a table entitled "Tensioner Interconnecting Plumbing" appears on FIG. 3. Referring to that table, under "Row Pairing," it is seen that the cylinders 28 in rows A and E are paired with each other, the cylinders 28 in rows B and D are paired with each other, and the cylinders 28 in row C are paired with themselves. Similarly, in further embodiments of the invention, table 18 is expanded by two rows 31, so that the cylinders 28 have the following pairing: rows A and G, rows B and F, rows C and E, and row D with row D. Finally, it should be noted that in the specific embodiment shown, each one of the four cylinders 28 in the set 28*a* is located near a different one of the four vertices 79 within each one of the substantially square areas 35.

Under "Column Pairing," it is seen that the cylinders 28 in columns 1 and 5 are paired with each other, the cylinders 28 in columns 2 and 4 are paired with each other, and the cylinders 28 in column 3 are paired with themselves. Similarly, in further embodiments of the invention, table 18 is expanded, for example, by two columns 32, so that the cylinders 28 have the following pairing: columns 1 and 7, columns 2 and 6, columns 3 and 5, and column 4 with column 4. As with the symmetrical pairing 81 by rows 31, the symmetrical pairing 81 by columns 32 may form cross-coupling arrangements 75 not explicitly disclosed, but are deemed to be implicitly disclosed because such cross-coupling arrangements 75 are within the same spirit and scope as the invention.

Under "Position Number Pairing," it is seen that a cylinder 28 in position 1 is paired with another cylinder 28 in position 1, a cylinder 28 in position 2 is paired with another cylinder 28 in position 2, a cylinder 28 in position 3 is paired with another cylinder 28 in position 3, and so forth. Similarly, in further examples, table 18 is expanded, such as by two cylinders 28, wherein the symmetrical pairing 81 by identical position-number 85 remains the same in kind, but differs only in amount of position numbers 85 to be paired. As with the symmetrical pairing 81 by rows 31 and by columns 32, although other position-number cross-coupling arrangements 75 are used in other embodiments of the invention.

Turning now to other aspects of the invention, a method and a system for supporting risers in a floating platform are disclosed. Although only the system is discussed below, the previous and foregoing discussions are understood to enable both the method and system disclosed herein.

Figure 4:
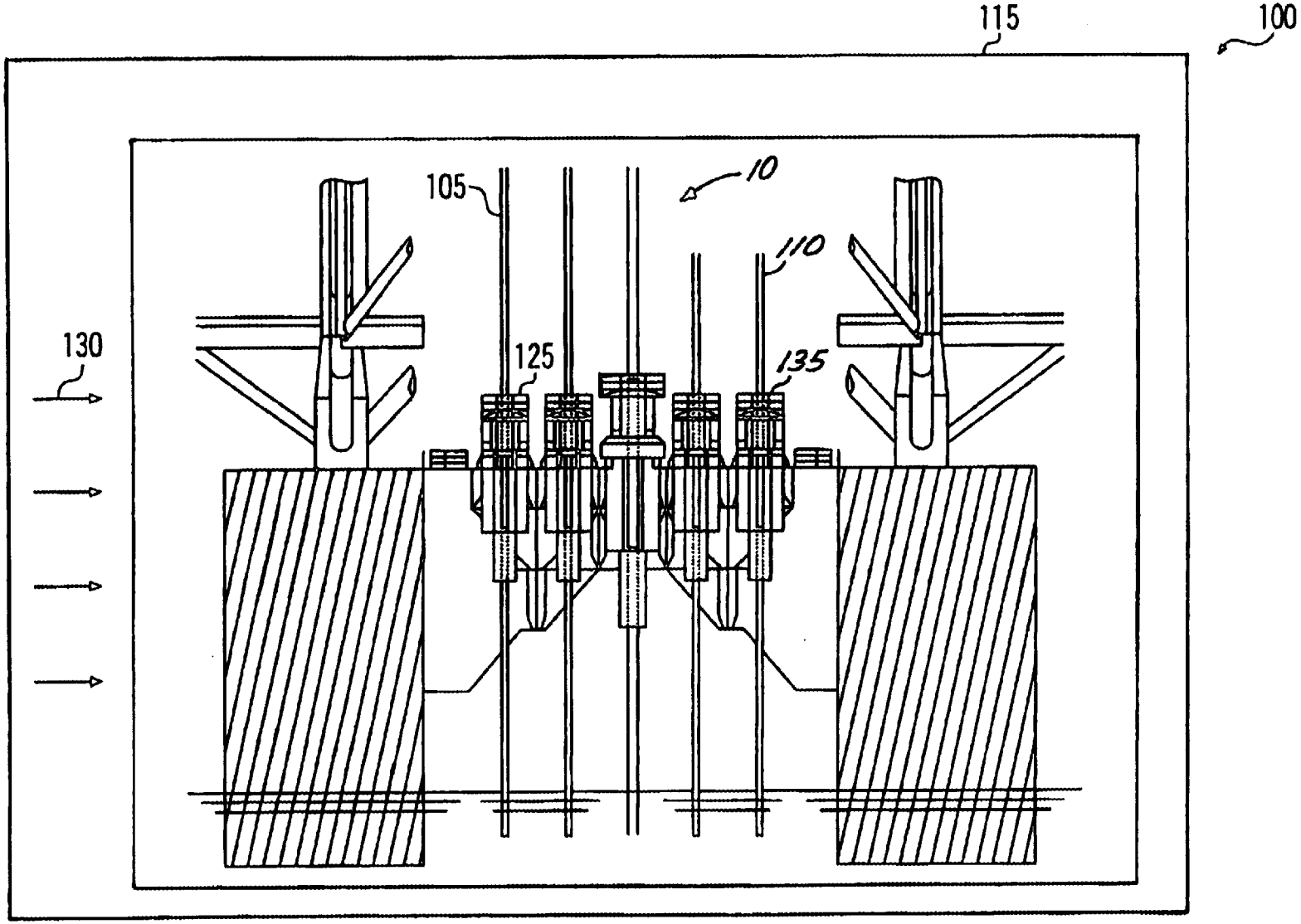
FIG. 4 is a schematic view of an example embodiment of the invention.

Accordingly, in one example embodiment, as seen in FIG. 4, a system 100 is disclosed for supporting a first riser 105 and a second riser 110 with a floating platform 115. The system 100 comprises a means 125 for tensioning the first riser 105 in response to an environmental load 130, and a means 135 for tensioning the second riser 110 in response to the same environmental load 130.

The means 125 for tensioning the first riser 105 is responsive to the means 135 for tensioning the second riser 110. The system 100 comprises the above-described apparatus 15 as shown in FIG. 1, wherein FIGS. 2 and 3 show a cross-coupling system between the cylinders 28 of the dedicated riser tensioners 27*a* and 27*b* for each and every one of the risers 10. Stated in terms of the system 100, the means 125 and 135 comprise the dedicated riser tensioners 27*a* and 27*b* for the first riser 105, the second riser 110, and all the other risers 10.

Having thus described exemplary embodiments of the invention, it will be apparent that various alterations, modifications and improvements will readily occur to those skilled in the art. Such obvious alterations, modifications and improvements, though not expressly described above, are nevertheless intended to be implied and are within the spirit and scope of the invention. Accordingly, the foregoing discussion is intended to be illustrative only, and not limiting; the invention is limited and defined by the following claims and equivalents thereto.

What is claimed is:

1. An apparatus for supporting risers in a floating platform, the apparatus comprising:

a hull top surface;

a table disposed above the hull top surface, the table comprising a grid structure having columns and rows that define riser openings;

a riser received in each of the riser openings; and a riser tensioner disposed in each of the riser openings and attached to the table, each riser tensioner comprising a plurality of cylinders selected from the group consisting of pneumatic cylinders and hydraulic cylinders;

wherein a first riser tensioner in a first riser opening is symmetrically paired by a cross coupling to a second riser tensioner in a second riser opening, the cross coupling being effected by interconnecting plumbing between each cylinder of the first riser tensioner and a corresponding paired cylinder of the second riser tensioner.

2. The apparatus of claim 1, wherein the apparatus comprises at least one drilling riser.

3. The apparatus of claim 1, wherein the apparatus comprises at least one production riser.

4. The apparatus of claim 1, wherein the apparatus comprises at least one drilling dedicated riser tensioner.

5. The apparatus of claim 1, wherein the apparatus comprises at least one production dedicated riser tensioner.

6. The apparatus of claim 1, wherein the plurality of cylinders comprises four cylinders coupled to each riser.

7. The apparatus of claim 1, wherein the cylinders comprise pneumatic cylinders.

8. The apparatus of claim 1, wherein the cylinders comprise hydraulic cylinders.

9. The apparatus of claim 1, wherein the table comprises a grid having rows and columns intersecting to form substantially square areas, wherein the first riser tensioner is cross coupled to the second riser tensioner by a cross coupling arrangement that comprises a symmetrical pairing by rows, a point of reference for the symmetrical pairing by rows being determined from the center of the grid structure.

10. The apparatus of claim 1, wherein the table comprises a grid having rows and columns intersecting to form substantially square areas, wherein the first riser tensioner is cross coupled to the second riser tensioner by a cross coupling arrangement that comprises a symmetrical pairing by columns, a point of reference for the symmetrical pairing by columns being determined from the center of the grid structure.

11. The apparatus of claim 1, wherein the table comprises a grid having rows and columns intersecting to form substantially square areas, wherein the first riser tensioner is cross coupled to the second riser tensioner by a cross coupling arrangement that comprises a symmetrical pairing by rows and columns, a point of reference for the symmetrical pairing by rows and columns being determined from the center of the grid structure.

* * * * *